US010875290B2

(12) United States Patent
Schaede

(10) Patent No.: US 10,875,290 B2
(45) **Date of Patent: *Dec. 29, 2020**

(54) SHEET-FED PRINTING PRESS FOR SIMULTANEOUS RECTO-VERSO PRINTING OF SHEETS, IN PARTICULAR FOR THE PRODUCTION OF SECURITY DOCUMENTS

(71) Applicant: KBA-NOTASYS SA, Lausanne (CH)

(72) Inventor: Johannes Schaede, Würzburg (DE)

(73) Assignee: KBA-NOTASYS SA, Lausannne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/486,375

(22) PCT Filed: Mar. 13, 2018

(86) PCT No.: PCT/EP2018/056247

§ 371 (c)(1),
(2) Date: Aug. 15, 2019

(87) PCT Pub. No.: WO2018/167064

PCT Pub. Date: Sep. 20, 2018

(65) Prior Publication Data

US 2020/0001591 A1 Jan. 2, 2020

(30) Foreign Application Priority Data

Mar. 14, 2017 (EP) ..... 17160749

(51) Int. Cl.
*B41F 11/02* (2006.01)
*B41F 7/12* (2006.01)
(Continued)

(52) U.S. Cl.
CPC ..... *B41F 11/02* (2013.01); *B41F 7/12* (2013.01); *B41F 9/002* (2013.01); *B41F 9/01* (2013.01); *B41F 9/021* (2013.01); *B41F 23/0453* (2013.01)

(58) Field of Classification Search
CPC .... B41F 7/12; B41F 9/01; B41F 9/002; B41F 9/021; B41F 9/005; B41F 9/006;
(Continued)

(56) References Cited

U.S. PATENT DOCUMENTS 3,384,011 A 5/1968 Bolza-Schunemann
5,042,378 A * 8/1991 Germann ..... B41F 11/02 101/152

(Continued)

FOREIGN PATENT DOCUMENTS

DE 1 268 153 5/1968
DE 1268153 5/1968

(Continued)

OTHER PUBLICATIONS

International Search Report for PCT/EP2018/056247, dated Jun. 5, 2018, 3 pages.

(Continued)

*Primary Examiner* — Jennifer E Simmons
*Assistant Examiner* — Quang X Nguyen
(74) *Attorney, Agent, or Firm* — Nixon & Vanderhye P.C.

(57) ABSTRACT

There is described a sheet-fed printing press (1000; 1000*) comprising at least two printing units (200; 200.1, 200.2; 200.1*, 200.2*) located one after the other, each printing unit (200; 200.1, 200.2; 200.1*, 200.2*) being adapted to carry out simultaneous recto-verso printing of the sheets (S) and including two printing cylinders (105, 106) cooperating with one an other and forming a printing nip, the two printing cylinders (105, 106) each collecting ink patterns from at least two associated plate cylinders (15A, 15B, 16A, 16B) wherein the two printing cylinders (105, 106) are located one above the other such that the sheets (S) travel laterally through each printing unit (200; 200.1, 200.2; 200.1*, 200.2*) from a first lateral side (201 *a;* 201 *a**)
(Continued)

located upstream of the printing nip to a second lateral side (201 *b;* 201 *b) located downstream of the printing nip, wherein a number of at least two sheet transfer elements (110, 120, 95) is provided downstream of the printing nip of a first one (200.1; 200.1*) and upstream of the printing nip of a second one (200.2; 200.2*) of the at least two printing units (200.1, 200.2; 200.1*, 200.2***) to transfer the sheets (S).

16 Claims, 7 Drawing Sheets

(51) Int. Cl.

| | |
|---|---|
| ***B41F 9/00*** | (2006.01) |
| ***B41F 9/01*** | (2006.01) |
| ***B41F 23/04*** | (2006.01) |
| ***B41F 9/02*** | (2006.01) |

(58) Field of Classification Search
CPC .. B41F 9/025; B41F 9/026; B41F 5/08; B41F 23/0453; B41F 11/02; B41F 5/00; B41F 5/10; B41F 5/06; B41F 5/02; B41F 5/16; B41F 23/044; B41F 23/045; B41F 23/0466; B41F 23/0459; B41F 9/00; B41F 7/06
See application file for complete search history.

(56) References Cited

U.S. PATENT DOCUMENTS

| | | | | |
|---|---|---|---|---|
| 5,555,804 | A | 9/1996 | Kojima | |
| 8,499,690 | B2 * | 8/2013 | Schwitzky | B41F 7/02 101/152 |
| 9,238,358 | B1 * | 1/2016 | Kamoda | B41F 7/12 |
| 9,381,734 | B2 * | 7/2016 | Kamoda | B41F 11/02 |
| 10,131,136 | B2 * | 11/2018 | Schaede | B41F 7/06 |
| 2003/0192662 | A1 * | 10/2003 | Heath | D21H 21/22 162/111 |
| 2007/0006757 | A1 * | 1/2007 | Kusaka | B41F 31/14 101/350.1 |
| 2012/0199025 | A1 * | 8/2012 | Funada | B41F 33/025 101/416.1 |
| 2013/0312625 | A1 * | 11/2013 | Kamoda | B41F 7/06 101/153 |
| 2014/0196621 | A1 * | 7/2014 | Riescher | B41F 7/14 101/217 |

FOREIGN PATENT DOCUMENTS

| | | | | |
|---|---|---|---|---|
| DE | 197 56 990 | | 7/1999 | |
| DE | 19756990 | | 7/1999 | |
| EP | 0906826 | | 4/1999 | |
| EP | 0949069 | | 10/1999 | |
| EP | 0976555 | | 2/2000 | |
| EP | 1060883 | | 12/2000 | |
| EP | 1323529 | | 7/2003 | |
| EP | 2357083 | | 8/2011 | |
| EP | 2484523 | | 8/2012 | |
| EP | 2583828 | | 4/2013 | |
| EP | 2647505 | | 10/2013 | |
| EP | 2653309 | | 10/2013 | |
| EP | 2756952 | | 7/2014 | |
| EP | 2845728 | | 3/2015 | |
| JP | 2004034641 | | 2/2004 | |
| JP | 2007168442 | A * | 7/2007 | B41F 23/0443 |
| WO | 2007/042919 | | 4/2007 | |
| WO | 2007/105059 | | 9/2007 | |
| WO | 2007/105061 | | 9/2007 | |
| WO | 2008/099330 | | 8/2008 | |
| WO | 2013/001009 | | 1/2013 | |
| WO | 2013/001010 | | 1/2013 | |
| WO | 2013/001518 | | 1/2013 | |
| WO | 2014/056711 | | 4/2014 | |
| WO | 2016/042482 | | 3/2016 | |
| WO | 2016/050862 | | 4/2016 | |
| WO | 2016/071870 | | 5/2016 | |

OTHER PUBLICATIONS

International Preliminary Report on Patentability for PCT/EP2018/056247, dated Oct. 12, 2018, 21 pages.

* cited by examiner

SHEET-FED PRINTING PRESS FOR SIMULTANEOUS RECTO-VERSO PRINTING OF SHEETS, IN PARTICULAR FOR THE PRODUCTION OF SECURITY DOCUMENTS

This application is the U.S. national phase of International Application No. PCT/EP2018/056247 filed 13 Mar. 2018, which designated the U.S. and claims priority to EP Patent Application No. 17160749.2 filed 14 Mar. 2017, the entire contents of each of which are hereby incorporated by reference.

TECHNICAL FIELD

The present invention generally relates to a sheet-fed printing press adapted to carry out recto-verso printing of individual sheets, in particular for the production of security documents such as banknotes, comprising one or more printing units each adapted to carry out simultaneous recto-verso printing of the sheets, each printing unit including two printing cylinders cooperating with one another and forming a printing nip where both sides of the sheets are simultaneously printed, the two printing cylinders each collecting ink patterns from at least two associated plate cylinders. The invention especially relates to a printing press preferably comprising a printing unit with at least a printing group designed to print a first side and/or a second side of the substrate by collecting different impressions or ink patterns in their respective colours on a cylinder, e. g. a collecting cylinder, in advance before being printed onto the substrate.

BACKGROUND OF THE INVENTION

Such printing presses are known as such in the art, in particular from European Patent Publication No. EP 0 949 069 A1 and International PCT Publications Nos. WO 2007/042919 A2, WO 2007/105059 A1, WO 2007/105061 A1, WO 2008/099330 A2, WO 2014/056711 A1, WO 2016/042482 A2 and WO 2016/071870 A1, which publications are all incorporated herein by reference in their entirety. International PCT Publication No. WO 2007/042919 A2 in particular discloses a recto-verso offset printing press adapted to carry out simultaneous recto-verso printing of sheets that further comprises an additional printing group placed upstream of a main printing group of the printing press.

FIGS. 1 and 2 illustrate such a recto-verso printing press that is adapted to carry out simultaneous recto-verso printing of sheets S, as typically used for the production of banknotes and like security documents, which printing press is designated globally by reference numeral 100. Such printing press is in particular marketed by the present Applicant under the product designation Super Simultan® IV. The basic configuration of the printing press 100 shown in FIGS. 1 and 2 is similar to that shown and discussed with reference to FIG. 1 of International PCT Publication No. WO 2007/042919 A2. This type of printing press is typically designated as a so-called "Simultan" (or "Simultan-offset") press owing to the fact that multiple colours are collected on a common blanket before being simultaneously transferred to the sheets S.

This printing press 100 comprises a printing unit 2, which is specifically adapted to perform simultaneous recto-verso printing of the sheets S (according to the so-called Simultan-offset printing principle) and comprises, as is typical in the art, two blanket cylinders (or printing cylinders) 5, 6 rotating in the directions indicated by the arrows and between which the sheets S are fed to receive multicolour impressions on both sides, namely on the recto and verso sides. In this example, blanket cylinders 5, 6 are three-segment cylinders which are supported between a pair of side frames designated by reference numeral 20. The blanket cylinders 5, 6 receive and collect different ink patterns in their respective colours from plate cylinders 15 and 16 (four on each side) which are distributed around a portion of the circumference of the blanket cylinders 5, 6. These plate cylinders 15 and 16, which each carry a corresponding printing plate, are themselves inked by corresponding inking apparatuses 25 and 26, respectively. The two groups of inking apparatuses 25, 26 are advantageously supported in two inking carriages 21, 22 that can be moved toward or away from the centrally-located plate cylinders 15, 16 and blanket cylinders 5, 6.

As is known in the art, each printing plate is wrapped around the corresponding plate cylinder 15, 16 and clamped at its leading end and trailing end by a suitable plate clamping system, which plate clamping system is located in a corresponding cylinder pit of the plate cylinder (see e.g. International (PCT) Publications Nos. WO 2013/001518 A1, WO 2013/001009 A1 and WO 2013/001010 A2, which are also incorporated herein by reference in their entirety).

Sheets S are fed from a sheet feeder 1 onto a feeder table 1* located next to the printing unit 2 (on the right-hand side in FIGS. 1 and 2) to a succession of transfer cylinders 9, 8', 10 (three cylinders in this example) placed upstream of the blanket cylinders 5, 6. While being transported by the transfer cylinder 8', the sheets S receive a first impression on a first side of the sheets S (namely the upper—or recto—side in the illustrated example, which side is identified by a black triangle in the drawings by opposition to the lower—or verso—side, which is identified by a white triangle) using an additional printing group, the transfer cylinder 8' fulfilling the additional function of impression cylinder. This additional printing group consists of, in addition to the transfer cylinder 8', a blanket cylinder 8 (a two-segment cylinder in this example) that collects inks from two plate cylinders 18 that are inked by corresponding inking apparatuses 28. The inking apparatuses 28 are advantageously supported in an inking carriage 24 that can be moved toward or away from the plate cylinders 18 and blanket cylinder 8. The sheets S that are printed by means of the additional printing group are first dried/cured by a drying/curing unit (designated by reference numeral 50 in FIG. 2) while being transported by the sheet transfer cylinder 8' before being transferred to the downstream-located main printing group. This drying/curing unit 50 can in particular be a UV curing device, such as a UV-LED curing device.

In the example of FIGS. 1 and 2, the sheets S are transferred onto the surface of blanket cylinder 5 where a leading edge of each sheet is held by appropriate gripper means located in cylinder pits between each segment of the blanket cylinder 5. Each sheet is thus transported by the blanket cylinder 5 to the printing nip between the blanket cylinders 5 and 6 where simultaneous recto-verso printing occurs. Once printed on both sides, the printed sheets S are then transferred, as known in the art, to a sheet conveying system 3 (such as a chain gripper system with spaced-apart gripper bars) for delivery in a sheet delivery unit 4 comprising multiple (e.g. three) delivery pile units 41, 42, 43. Reference numeral 31 in FIG. 2 designates a pair of chain wheels located at the upstream end of the sheet conveying system 3.

In the example of FIGS. 1 and 2, first and second transfer cylinders or drums 11, 12, such as suction drums or cylinders, are interposed between the sheet conveying system 3 and the blanket cylinder 5. These first and second transfer cylinders 11, 12 are optional (and could therefore be omitted) and are designed to carry out inspection of the sheets S on the recto and verso sides as described for instance in International application No. WO 2007/105059 A1. Reference numerals 61, 62 in FIG. 2 designate corresponding inspection cameras (such as line-scan cameras) that cooperate with cylinder or drums 11, 12.

FIG. 3 schematically shows a partial side view of a printing unit, designated by reference numeral 2*, of a printing press 100* in accordance with FIG. 3 of International PCT Publication No. WO 2016/071870 A1.

The printing press 100* comprises a main printing group consisting of elements 5, 6, 15, 16, 25, 26, including first and second printing cylinders 5, 6 cooperating with one another to form a first printing nip between the first and second printing cylinders 5, 6 where first and second sides of the sheets S are simultaneously printed, the first printing cylinder 5 acting as a sheet conveying cylinder of the main printing group. The configuration of the main printing group is as such identical to that of the main printing group illustrated in FIGS. 1 and 2. In this other example, printing cylinders 5, 6 are likewise three-segment cylinders which are supported between a pair of side frames 20. The printing cylinders 5, 6 receive and collect different ink patterns in their respective colours from first and second sets of four plate cylinders 15, respectively 16, which are distributed around a portion of the circumference of the printing cylinders 5, 6. These plate cylinders 15 and 16, which each carry a corresponding printing plate, are again inked by corresponding sets of four inking apparatuses 25 and 26, respectively. The two sets of inking apparatuses 25, 26 are likewise supported in two retractable inking carriages 21, 22 that can be moved toward or away from the centrally-located plate cylinders 15, 16 and printing cylinders 5, 6.

In contrast to the configuration illustrated in FIGS. 1 and 2, the additional printing group comprises third and fourth printing cylinders 7, 8 cooperating with one another to form a second printing nip between the third and fourth printing cylinders 7, 8 where both sides of the sheets S are simultaneously printed, the third printing cylinder 7 acting as a sheet conveying cylinder of the additional printing group. Each printing cylinder 7, 8 collects inks from corresponding sets of two plate cylinders 17, respectively 18, that are inked by corresponding inking apparatuses 27, 28. These two sets of inking apparatuses 27, 28 are likewise supported in two retractable inking carriages 23, 24 that can be moved toward or away from the centrally-located plate cylinders 17, 18 and printing cylinders 7, 8 (which carriages 23, 24 could be distinct from or form an integral part of the inking carriages 21, 22 of the main printing group).

As shown in FIG. 3, the additional printing group 7, 8, 17, 18, 27, 28 is placed upstream of and above the main printing group 5, 6, 15, 16, 25, 26, the first and second printing cylinders 5, 6, on the one hand, and the third and fourth printing cylinders 7, 8, on the other hand, being aligned along two horizontal planes.

The main printing group 5, 6, 15, 16, 25, 26 and the additional printing group 7, 8, 17, 18, 27, 28 are coupled to one another by means of an intermediate sheet conveying system comprising, in the illustrated embodiment, first to third sheet transfer cylinders 10', 10", 10'" interposed between the first and third printing cylinders 5, 7. More precisely, the sheets S printed in the additional printing group 7, 8, 17, 18, 27, 28 are transferred from the third printing cylinder 7 in succession to the first sheet transfer cylinder 10', to the second sheet transfer cylinder 10", to the third sheet transfer cylinder 10'", and then to the first printing cylinder 5 of the main printing group.

On their way to the main printing group 5, 6, 15, 16, 25, 26, the sheets S are dried/cured by first and second drying/curing devices 51, 52 cooperating for instance respectively with the first and second sheet transfer cylinders 10', 10". The drying/curing devices 51, 52 are typically UV curing devices, in particular UV-LED curing devices.

The sheets S to be printed are fed in succession from the sheet feeder (not shown in FIG. 3) onto the feeder table 1* where they are conventionally aligned before being fed to a succession of e.g. three sheet transfer cylinders 9, 9', 9" at the infeed. As illustrated in FIG. 3, the sheets S are fed in succession by the sheet transfer cylinders 9, 9', 9" to the third printing cylinder 7. The sheets S thus receive first and second impressions on both sides which are performed simultaneously at the printing nip between the third and fourth printing cylinders 7, 8 of the additional printing group and at the printing nip between the first and second printing cylinders 5, 6 of the main printing group.

Once fully printed, the sheets S can likewise be inspected on both sides by means of an inspection system 11, 12, 61, 62 similar to the one described with reference to FIGS. 1 and 2, and then transferred to the sheet conveying system 3 for delivery to the sheet delivery unit (not shown in FIG. 3).

In the examples of FIGS. 1 to 3, one will appreciate that the sheet path runs through the printing unit 2, respectively 2*, from top to bottom. One limitation of the printing presses of FIGS. 1 to 3, resides in that expansion possibilities are somewhat limited by the available installation height in the relevant printing works where the printing press is to be installed. The basic configuration of the printing presses of FIGS. 1 to 3 is however a huge advantage in terms of colour-to-colour register accuracy thanks to the fact that such printing presses are designed to operate according to the Simultan-offset printing process.

FIG. 4 shows another known sheet-fed printing press, designated globally by reference numeral 100, for recto-verso printing press of sheets S as for instance disclosed in U.S. Pat. No. 5,555,804, which other publication is also incorporated herein by reference in its entirety. This type of printing press, which (like the printing presses of FIGS. 1 to 3**) does not require any sheet reversal system to print both sides of the sheets S, is typically designated as a so-called "double-decker" press. Other examples of such double-decker presses are disclosed for instance in Japanese Patent Publication No. JP 2004-034641 A and European Patent Publications Nos. EP 0 906 826 A2, EP 0 976 555 A1, EP 1 060 883 A1, EP 1 323 529 A1, EP 2 357 083 A1, EP 2 484 523 A1, EP 2 583 828 A1, EP 2 647 505 A1, EP 2 653 309 A1, EP 2 756 952 A1 and EP 2 845 728 A2.

In contrast to the examples of FIGS. 1 to 3, the printing press of FIG. 4 is not adapted for simultaneous recto-verso printing of the sheets S. Rather, the sheets S are fed in succession from the sheet feeder 1 (via the feeder table 1* and sheet transfer cylinder 9 at the infeed) through a series of printing units 2.1-2.8 which are designed to print the recto and verso sides of the sheets S in an alternate and consecutive manner. More precisely, printing units 2.1, 2.3, 2.5 and 2.7 are designed to print the upper (recto) side of the sheets S, while printing units 2.2, 2.4, 2.6 and 2.8 are designed to print the lower (verso) side of the sheets S.

As depicted in FIG. 4, the printing units 2.1, 2.3, 2.5, 2.7 each comprise an impression cylinder 10.1-10.4 (located below the path of the sheets S) cooperating with an associated blanket cylinder 5.1-5.4 (located above the path of the sheets S), which blanket cylinder receives a relevant ink pattern to be transferred onto the recto side of the sheets S from a corresponding plate cylinder 15.1-15.4 inked by an inking apparatus 25.1-25.4. Once printed by the printing units 2.1, 2.3, 2.5, 2.7, the sheets S are transferred from the relevant impression cylinder 10.1-10.4 to the relevant impression cylinder 11.1-11.4 of the downstream-located printing unit 2.2, 2.4, 2.6, 2.8, which impression cylinder 11.1-11.4 is located above the path of the sheets S. A series of eight impression cylinders 10.1-10.4, 11.1-11.4 is thus provided to transport the sheets S consecutively through the eight successive printing units 2.1 to 2.8.

Printing units 2.2, 2.4, 2.6, 2.8 are basically the mirror image of the printing units 2.1, 2.3, 2.5, 2.7 and likewise each comprise a blanket cylinder 6.1-6.4 (located in this case below the path of the sheets S) cooperating with the associated impression cylinder 11 located thereabove and receiving a relevant ink pattern to be transferred onto the verso side of the sheets S from a corresponding plate cylinder 16.1-16.4 inked by an inking apparatus 26.1-26.4.

Once printed by the last printing unit 2.8 in the sequence, the sheets S are transferred to a sheet conveyor system 3 via a final transfer cylinder 13 for transport and delivery to the sheet delivery unit 4. Only one delivery pile unit 41 is depicted in FIG. 4, but multiple delivery pile units could be contemplated as in the example of FIG. 1.

In the example of FIG. 4, one will appreciate that the sheet path runs through the printing units 2.1-2.8 from right to left along a substantially horizontal direction, rather than vertically as in the examples of FIGS. 1 to 3. Furthermore, the sheets S are subjected in the example of FIG. 4 to eight consecutive printing steps, one in each printing unit 2.1-2.8, whereas, in the examples of FIGS. 1 to 3, the sheets S are subjected to only two consecutive printing steps, namely a first printing step in the additional printing group and a second, subsequent printing step in the main printing group. In that respect, one major limitation of the printing press type depicted in FIG. 4 resides in increased sheet distortion (as each printing step adds up to the distortion of the sheets S) which negatively impacts colour-to-colour register accuracy. Furthermore, while the printing press of FIG. 4 is flexible in that additional printing units could be provided, the machine footprint is necessarily increased as a result of such addition.

There is therefore a need for an improved printing press configuration which would be flexible in terms of modularity, while retaining as much as possible the high colour-to-colour register accuracy of the aforementioned Simultan presses.

SUMMARY OF THE INVENTION

A general aim of the invention is to improve the known printing presses of the aforementioned type.

More precisely, an aim of the present invention is to provide such a printing press that is adapted to carry out recto-verso printing of individual sheets with a high colour-to-colour register accuracy while being flexible in terms of expansion possibilities.

Another aim of the present invention is to provide such a printing press where machine operability and accessibility are not compromised.

These aims are achieved thanks to the printing press defined in the claims. In particular, there is provided a sheet-fed printing press adapted to carry out recto-verso printing of individual sheets, in particular for the production of security documents such as banknotes, comprising one or more printing units each adapted to carry out simultaneous recto-verso printing of the sheets, each printing unit including two printing cylinders cooperating with one another and forming a printing nip where both sides of the sheets are simultaneously printed, the two printing cylinders each collecting ink patterns from at least two associated plate cylinders. According to the invention, the two printing cylinders are located one above the other such that the sheets travel laterally through each printing unit from a first lateral side located upstream of the printing nip to a second lateral side opposite to the first lateral side and located downstream of the printing nip.

Instead or preferably in addition to the above, in a preferred embodiment a printing group of a respective printing unit is designed as printing group for indirect printing, such as indirect lithographic printing, i.e. offset printing, or an indirect relief printing, e. g. letterset printing, or a combination of both of them.

A so called collect printing group is designed to print at least one side of the substrate by firstly collecting several impressions or patterns from several plate cylinders on a printing cylinder, e. g. a so called collecting cylinder, before being printed as a collected image as a whole onto the substrate.

The printing unit or especially the collect printing group preferably can be configured with at least one or more inking apparatuses and associated plate cylinders designed to enable and/or carry out offset printing, comprising for example a dampening system and/or at least the possibility to place lithographic printing plates onto the respective plate cylinder. Although these inking apparatuses possibly can also be run for letterset printing without or with inactive dampening system and with a letterpress printing plate, the printing group or printing unit nevertheless is designed—at least partly—as an offset printing group respectively printing unit. In addition to plate cylinders and inking apparatuses designed to enable and/or carry out offset printing a collect printing group or unit can comprise additional plate cylinders with associated inking apparatuses designed to especially carry out only other kinds of printing, for example letterset printing. In this sense, the above collect printing unit or group shall be understood as an offset printing unit or group, provided at least one, more or all of its plate cylinders and corresponding inking apparatuses is or are designed to enable and/or carry out offset printing.

In an alternative embodiment, the printing unit or especially the collect printing group can be configured only with one or more plate cylinders and associated inking apparatuses designed to enable and/or carry out indirect relief printing, e.g. such as letterset printing.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 5:
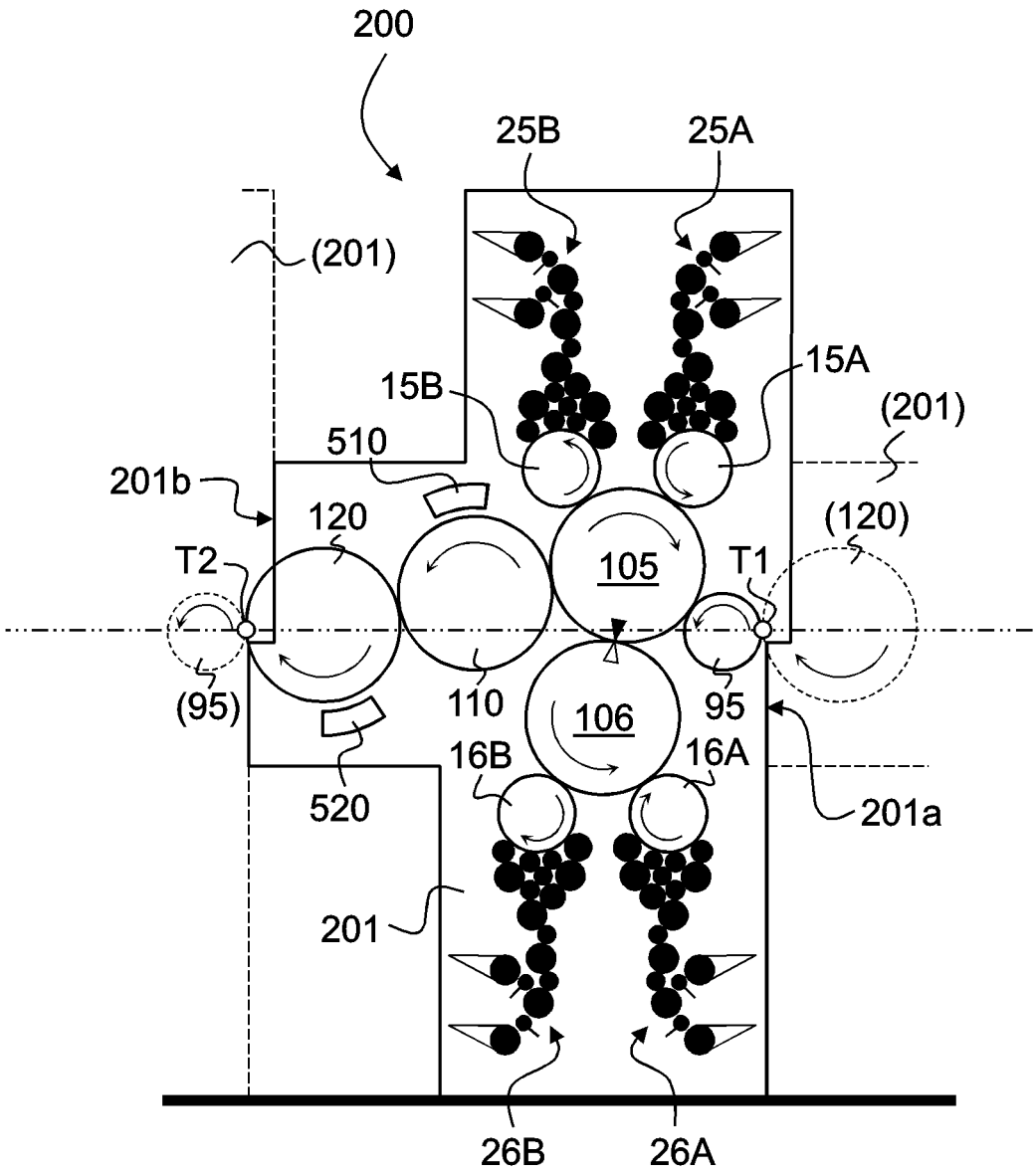
FIG. 5 is a schematic partial side view of a printing unit of a printing press in accordance with a first embodiment of the invention.
Figure 6:
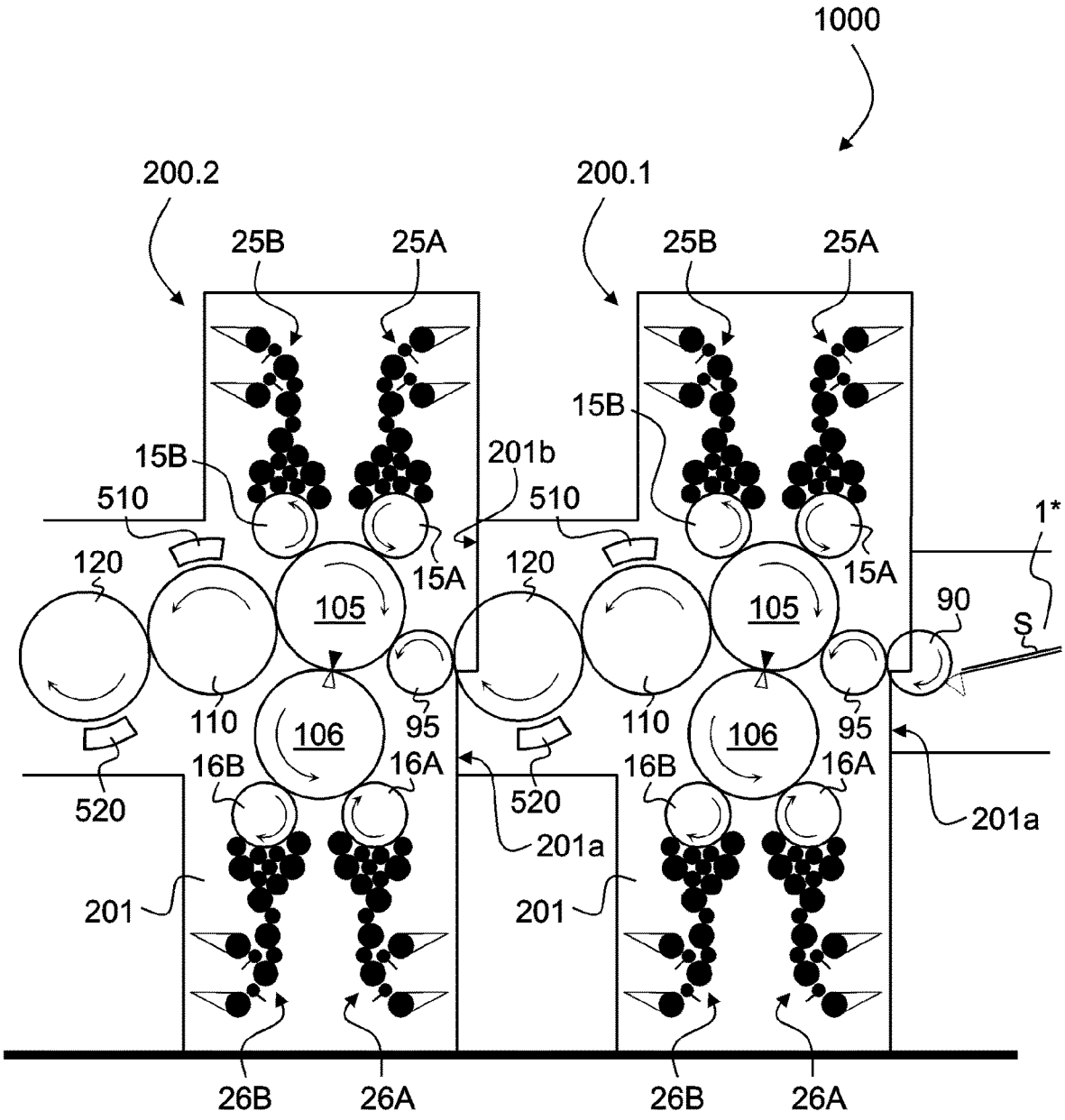
FIG. 6 is a schematic partial side view of a printing press comprising at least two printing units as shown in FIG. 5 in accordance with another embodiment of the invention.
Figure 7:
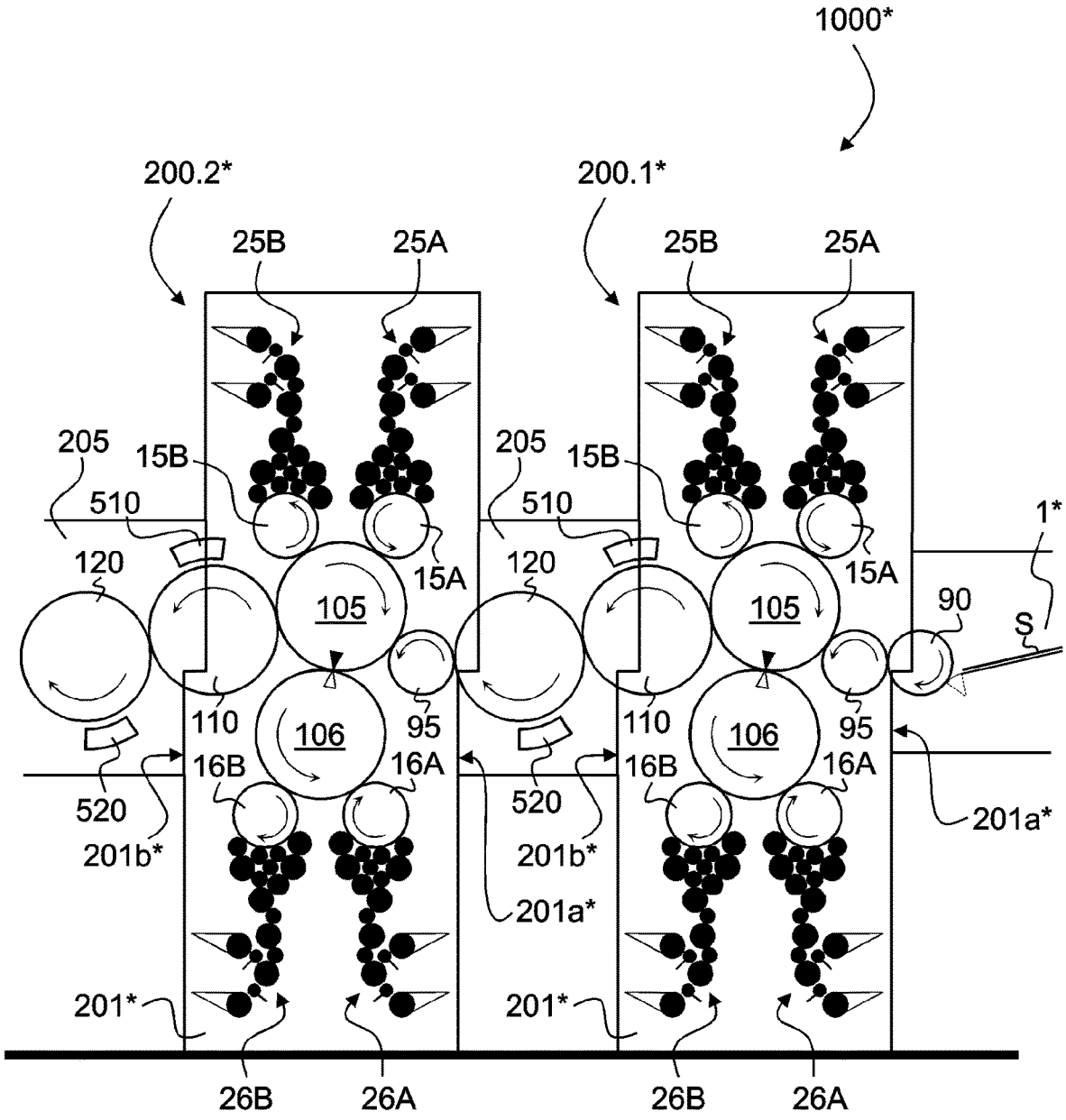
FIG. 7 is a schematic partial side view of a printing press comprising at least two printing units in accordance with a further embodiment of the invention.

The present invention will be described in the particular context of a sheet-fed recto-verso printing press adapted to carry out offset printing on both sides of the sheets and comprising one or more printing units each exhibiting a (2)-over-(2) Simultan configuration. It shall be appreciated however that the invention is not limited to this particular configuration and could be extended to any (m)-over-(n) Simultan configuration where variables m and n are integers greater or equal to 2. This being said, the printing press configurations as shown in FIGS. 5 to 7 are particularly preferred as they exhibit a reasonably simple configuration while still allowing unprecedented expansion capabilities and great modularity. As this will be appreciated from reading the following description of embodiments of the invention, the preferred (2)-over-(2) Simultan printing unit configuration would allow any printing press configuration for (2×N)-over-(2×N) recto-verso printing (N being an integer number equal to the number of individual (2)-over-(2) Simultan printing units. The expression "(m)-over-(m) configuration" is to be understood as a simultaneous recto-verso printing with m colour separations or frames printed on each side and/or a configuration of a recto-verso printing press, printing unit or group comprising a first set of m plate cylinders cooperating with a first printing cylinder and a second set of m plate cylinders cooperating with a second printing cylinder, which first and second printing cylinders cooperate to build a common printing nip.

The expression "printing group" will be used for the equipment, e.g. the cylinders, rollers and the means of the inking unit(s), belonging to a printing nip for at least printing on one side of the substrate. A double sided printing group therefor is a special printing group with two printing groups, one on or for each side of the substrate path, sharing a same printing nip for printing simultaneously both sides of a passing substrate and mutually acting with its printing cylinders as counter-pressure cylinders for the other printing group. It is to be understood, that several printing groups can be arranged in a same printing unit, with these printing groups for example being arranged in single- or multi-part frame walls.

In the context of the present invention, the expression "printing cylinder(s)" will be used to designate the relevant cylinders of the printing press that directly cooperate with the first or second side of the sheets S to transfer printing patterns thereon. This expression is however interchangeable with the expression "blanket cylinder", it being to be understood that the relevant printing cylinders each carry a number of printing blankets. In the embodiments of FIGS. 5 to 7, these printing (or blanket) cylinders are designated by reference numerals 105 and 106 and are two-segment cylinders. The printing cylinders could however present any suitable size or diameter.

The expression "upper side" (or "recto side") and "lower side" (or "verso side") are used in the following description to designate the two opposite sides of the sheets S being printed. More precisely, in the illustrations of FIGS. 1 to 7, the "upper/recto side" designates the side of the sheets S that is identified by the black triangles in the drawings, while the "lower/verso side" designates the side of the sheets S that is identified by the white triangles in the drawings. These expressions are however interchangeable.

FIG. 5 schematically shows a partial side view of a printing unit, designated by reference numeral 200, of a printing press in accordance with an embodiment of the invention. While only one printing unit 200 is depicted in FIG. 5, the relevant printing press could comprise any desired number of printing units 200 located one after the other, all sharing the same or substantially the same configuration. A sheet-feeder, feeder table, sheet conveying system and sheet delivery unit are not shown in FIG. 5, but it shall be appreciated that such components—which are known as such in the art—would typically be provided to ensure feeding of sheets S to the (first) printing unit in the sequence and conveyance of the printed sheets S from the last printing unit in the sequence to the delivery unit. Furthermore, any additional printing or processing unit could be provided upstream or downstream of any one of the printing units 200, including but not limited to an inspection system for inspecting one or both sides of the sheets, a coating unit for coating one or both sides of the sheets with e.g. a varnish, or any other printing unit operating in accordance with any desired printing process (such as intaglio printing, screen printing, letterpress printing, etc.).

The printing unit 200 illustrated in FIG. 5 is specifically designed to be able to be coupled to at least another, identical printing unit 200, be it on the upstream side and/or downstream side. More precisely, the printing unit 200 includes two printing cylinders 105, 106 cooperating with one another and forming a printing nip where both sides of the sheets S are simultaneously printed. These two printing cylinders 105, 106 are located one above the other such that the sheets S travel laterally (here from the right to the left) through the printing unit 200 from a first lateral side, designated by reference numeral 201*a*, located upstream of the printing nip formed by the two printing cylinders 105, 106 to a second lateral side, designated by reference numeral 201*b*, opposite to the first lateral side 201*a* and located downstream of the printing nip. In the illustrated example, the first printing cylinder 105 acts as a sheet conveying cylinder and transports the individual sheets S to and past the printing nip.

The second printing cylinder 106 could alternatively be designed as the sheet conveying cylinder, in which case conveyance of the sheets S to and away from the printing nip between the two printing cylinders 105, 106 would have to be changed accordingly. In the context of the present invention, it does not really matter if the sheets S are conveyed by the first or second printing cylinder.

As illustrated in FIG. 5, the printing unit 200 is preferably designed as a (2)-over-(2) Simultan unit comprising first and second plate cylinders 15A, 15B cooperating with the first printing cylinder 105 and third and fourth plate cylinders 16A, 16B cooperating with the second printing cylinder 106.

In the illustrated example, the first and second plate cylinders 15A, 15B are accordingly located above the first printing cylinder 105, while the third and fourth plate cylinders 16A, 16B are located below the second printing cylinder 106. Each of the plate cylinders 15A, 15B, 16A, 16B is inked by a corresponding inking apparatus 25A, 25B, 26A, 26B, which inking apparatuses 25A, 25B, 26A, 26B can advantageously be designed to each comprise two ink fountains, which configuration is useful for rainbow printing.

Each inking apparatus 25A, 25B, 26A, 26B is conveniently designed to extend along a substantially vertical direction above or below the associated plate cylinder 15A, 15B, 16A, 16B, thereby freeing space to get access to the plate cylinders 15A, 15B, 16A, 16B for the purpose e.g. of mounting or removing the printing plates from the circumference of the plate cylinders 15A, 15B, 16A, 16B. For each ink fountain, there is defined at least one reference plane, that intersects with that respective ink fountain and that contains the rotational axis of the plate cylinder 15A, 15B, 16A, 16B associated with that respective ink fountain. An inking apparatus designed to extend along a substantially vertical direction above or below the associated plate cylinder 15A, 15B, 16A, 16B is preferably characterized in that for at least one ink fountain of that inking apparatus and preferably for each ink fountain of that inking apparatus, the at least one respective reference plane contains at least one straight reference line, and in that this at least one straight reference line is oriented perpendicularly to the rotational axis of the plate cylinder 15A, 15B, 16A, 16B associated with that respective ink fountain and in that this at least one straight reference line together with a vertical straight line confines an angle that is smaller than 45°, more preferably smaller than 35°, more preferably smaller than 25° and most preferably smaller than 20°. Alternatively, the inking apparatus 25A, 25B, 26A, 26B could be located in corresponding inking carriages designed to be retractable away from the plate cylinders 15A, 15B, 16A, 16B.

In the illustrated example, the first and second printing cylinders 105, 106, the corresponding plate cylinders 15A, 15B, 16A, 16B, as well as the associated inking apparatuses 25A, 25B, 26A, 26B (unless the latter are supported in inking carriages as mentioned above) are supported between a pair of side frames 201, which pair of side frames 201 forms corresponding connection interfaces on the first and second lateral sides 201*a*, 201*b* at the input/upstream side and output/downstream side of the printing unit 200. By way of preference, the pair of side frames 201 also supports a first sheet transfer element 95, in particular a first sheet transfer cylinder 95, cooperating with the first printing cylinder 105 upstream of the printing nip and at least a second sheet transfer element 110, in particular a second sheet transfer cylinder 110, cooperating with the first printing cylinder 105 downstream of the printing nip. Even more preferably, the pair of side frames 201 also supports a third sheet transfer element 120, in particular a third sheet transfer cylinder 120, cooperating with the second sheet transfer cylinder 110 to take away the sheets S from the second sheet transfer cylinder 110. In other words, in the example of FIG. 5, the sheets S travel laterally through the printing unit 200 from a first sheet transfer location (or "sheet input location") T1 located on the first lateral side 201*a* (namely the sheet transfer location to the first sheet transfer cylinder 95) to a second sheet transfer location (or "sheet output location") T2 located on the second lateral side 201*b* (namely the sheet transfer location from the third sheet transfer cylinder 120), the sheets S being transported in succession by cylinders 95, 105, 110 and 120.

Sheet transfer elements 110, 120, 95 are exemplarily shown as sheet transfer cylinder 110, 120, 95 throughout the drawings. Nevertheless, at least one of the sheet transfer elements 110, 120, 95 or a plurality of the sheet transfer elements 110, 120, 95 or all of the sheet transfer elements 110, 120, 95 are alternatively embodied as another kind of sheet transfer element 110, 120, 95, e.g. a chain gripper system 110, 120, 95 and/or a gripper system 110, 120, 95 being moveable by a transport element, such as a cylinder or a transfer drum. In particular, at least two separate gripper systems 110, 120, 95 spaced apart in a circumferential direction around a common transfer cylinder 110, 120, 95 carrying these at least two gripper systems 110, 120, 95 can be regarded as at least two transfer elements 110, 120, 95. Preferably, at least one of the sheet transfer elements 110, 120, 95 is embodied as a gripper system or as a chain gripper system 110, 120, 95 or as a sheet transfer cylinder 110, 120, 95 comprising at least one gripper system. More preferably, at least two of the sheet transfer elements 110, 120, 95 are embodied as a respective gripper system and/or as a respective chain gripper system 110, 120, 95 and/or as a respective sheet transfer cylinder 110, 120, 95 comprising at least one gripper system. In an exemplary embodiment, the first sheet transfer element 95 is embodied as a first sheet transfer cylinder 95 and/or the second sheet transfer element 110 is embodied as a second sheet transfer cylinder 110 and/or the third sheet transfer element 120 is embodied as a third sheet transfer cylinder 120.

According to the preferred embodiment shown in FIG. 5, first and second drying or curing units 510, 520 are further located downstream of the printing nip of the at least one and preferably of the respective printing unit 200; 200.1, 2001.2; 200.1*, 200.2* between the two printing cylinders 105, 106, namely about a corresponding portion of the circumference of the second and third sheet transfer cylinders 110, 120, respectively, where the sheets S are transported. The second drying or curing unit 520 could alternatively be cooperating directly with the circumference of the first printing cylinder 105 immediately after the printing nip so as to dry or cure the verso/lower side of the sheets S. The drying or curing units 510, 520 are preferably UV-curing units, such as UV-LED curing units. The second and third sheet transfer cylinders 110, 120 could again alternatively be embodied as any other kind of sheet transfer elements 110, 120.

Ideally, the sheet transfer location T1 to the first sheet transfer element 95 or first sheet transfer cylinder 95 and the sheet transfer location T2 away from the third sheet transfer element 120 or third sheet transfer cylinder 120 are located at a same height, as illustrated in FIG. 5, thereby allowing a direct coupling of two identical printing units 200 one after the other, in which case the third sheet transfer element 120 or third sheet transfer cylinder 120 of the upstream-located printing unit 200 is made to cooperate directly with the first sheet transfer element 95 or first sheet transfer cylinder 95 of the downstream-located printing unit 200.

Such a configuration where at least two identical printing units 200.1, 200.2 are coupled directly to one another is shown in the embodiment of FIG. 6. Indeed, FIG. 6 is a schematic partial side view of a printing press designated by reference numeral 1000 and comprising at least two printing units 200.1, 200.2 of the same type as previously described in connection with FIG. 5. Components 15A, 15B, 16A, 16B, 25A, 25B, 26A, 26B, 95, 105, 106, 110, 120, 201, 510, 520 in FIG. 6 are the same components as described in connection with FIG. 5 and do not therefore need to be described again. It suffices to understand that the two printing units 200.1, 200.2 are coupled directly to one another, with the second lateral side 201*b* of the first printing unit 200.1 being coupled to the first lateral side 201*a* of the second printing unit 200.2. In the illustration of FIG. 6, the first lateral side 201*a* of the first printing unit 200.1 is shown coupled to a feeder table 1* of a sheet feeder, which feeder table 1* is provided with a sheet transfer element 90 or sheet transfer cylinder 90 acting as infeed and receiving individual sheets S from e.g. a swing-gripper arm system. The second lateral side 201*b* of the second printing unit 200.2 (not shown in FIG. 6) could likewise be coupled to a third printing unit in a similar manner to the first and second printing units 200.1, 200.2.

Figure 4:
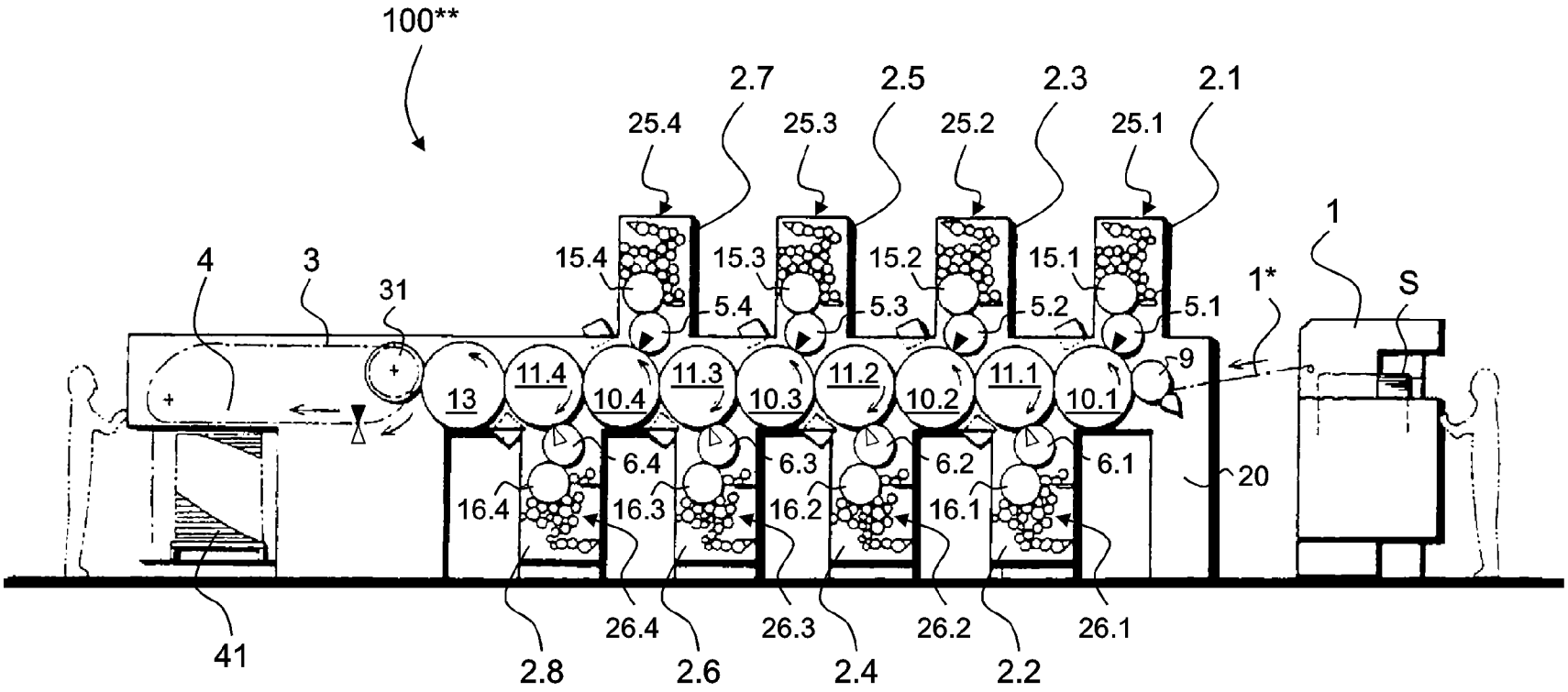
Fig. 4 (PRIOR ART)
FIG. 4 is a schematic partial side view of a known double-decker-type recto-verso printing press exhibiting a configuration similar to that disclosed in U.S. Pat. No. 5,555,804.

The last printing unit in the sequence of printing units could likewise be coupled to any suitable sheet conveying system for transporting the printed sheets S to a corresponding sheet delivery unit in a manner similar to what is shown e.g. in FIG. 4, in which case a suitable sheet transfer element or sheet transfer cylinder could equally be interposed between the third sheet transfer element 120 or third sheet transfer cylinder 120 of the last printing unit in the sequence and the upstream end of a sheet conveying system 3 (like the sheet transfer cylinder 13 depicted in FIG. 4).

Figure 1:
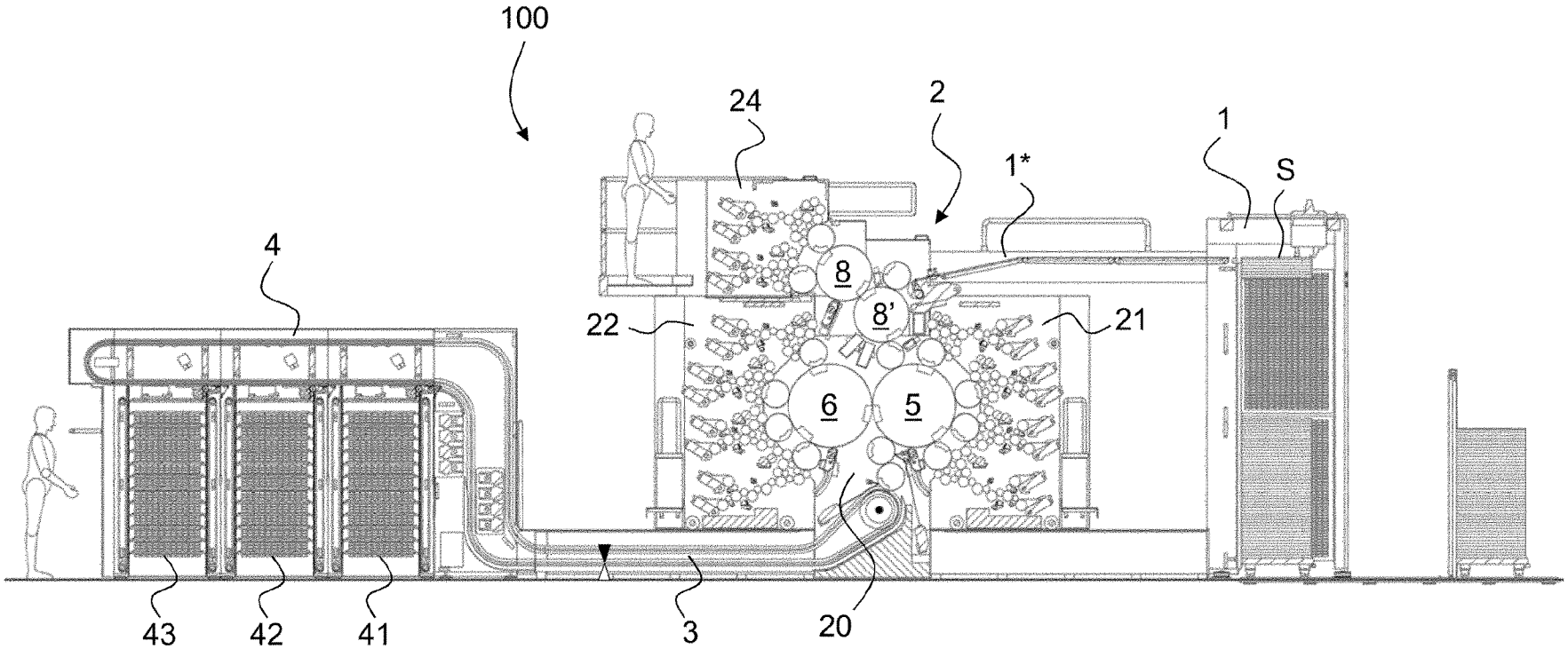
Fig. 1 (PRIOR ART)
FIG. 1 is schematic illustration of a known Simultan-type recto-verso printing press exhibiting a configuration similar to that disclosed in International PCT Publication No. WO 2007/042919 A2.
Figure 2:
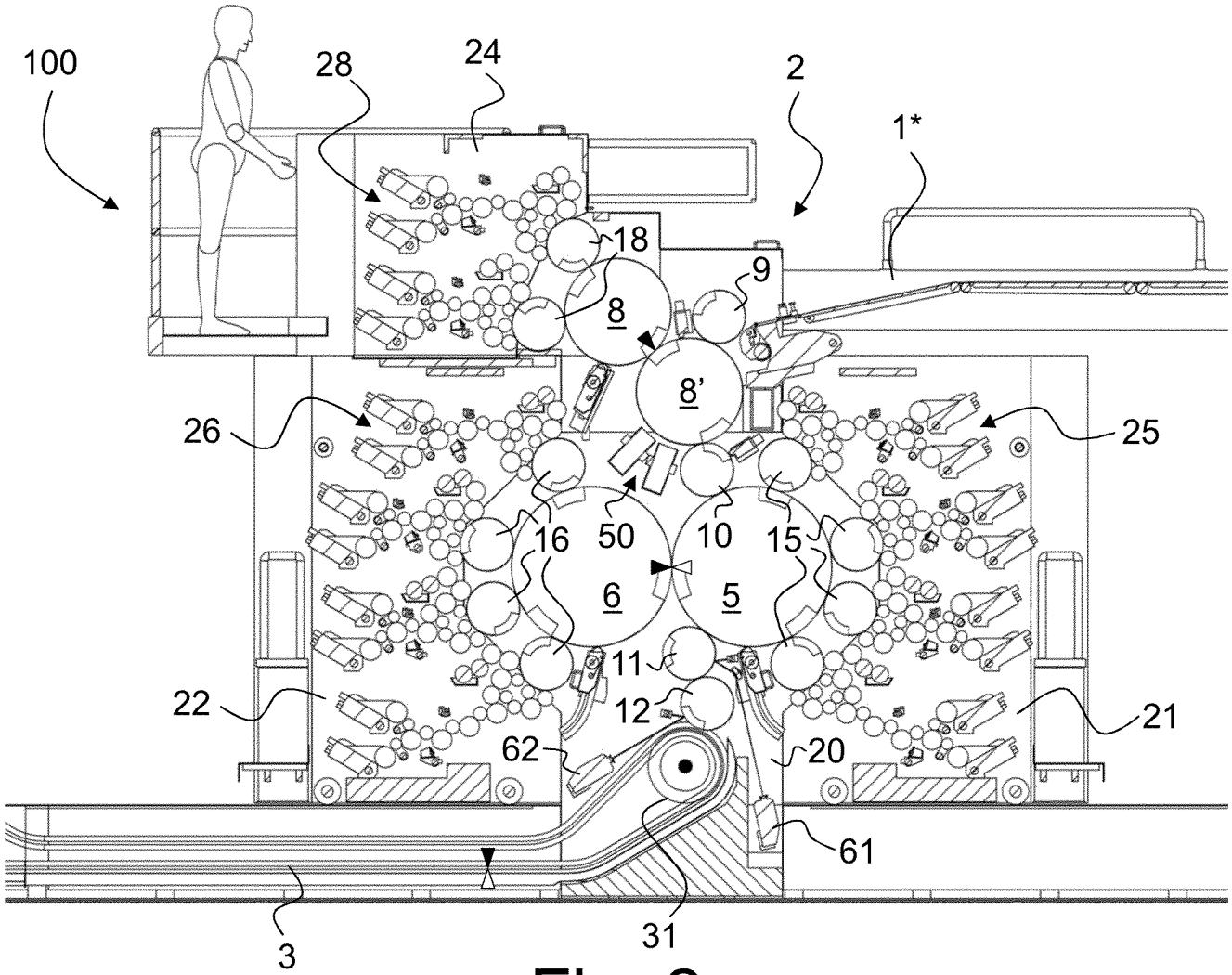
Fig. 2 (PRIOR ART)
FIG. 2 is a schematic partial side view of the printing unit of the printing press of FIG. 1.
Figure 3:
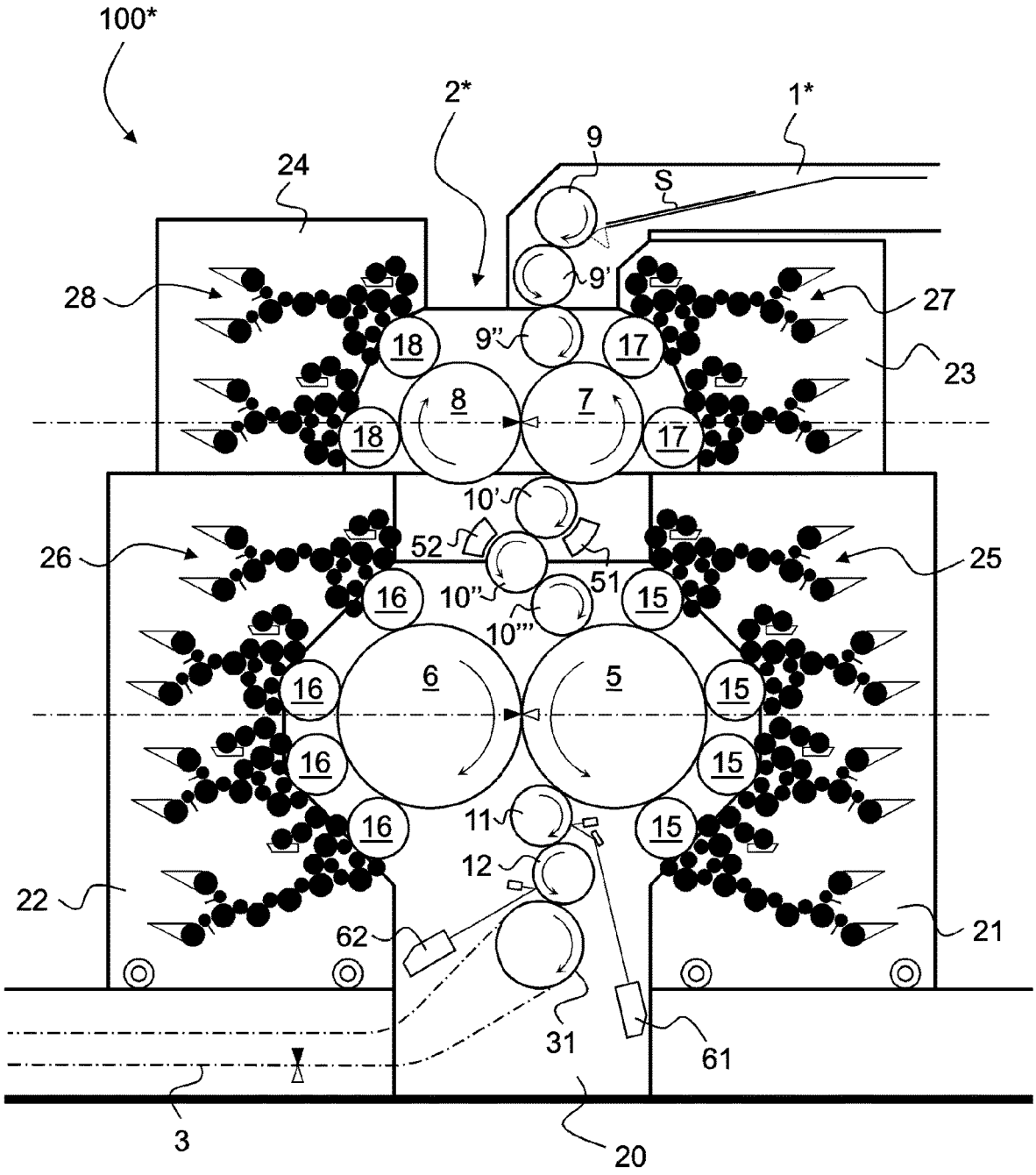
Fig. 3 (PRIOR ART)
FIG. 3 is a schematic partial side view of the printing unit of a known Simultan-type recto-verso printing press exhibiting a configuration similar to that disclosed in International PCT Publication No. WO 2016/071870 A1.

While this is not specifically illustrated, an inspection system similar to the inspection system 11, 12, 61, 62 shown in FIGS. 1 to 3 could likewise be provided downstream of the last printing unit with a view to inspect both sides of the printed sheets S.

FIG. 7 shows another embodiment of a printing press, designated by reference numeral 1000*, according to the invention and comprising at least two printing units 200.1*, 200.2* which are located one after the other. Like in the embodiment of FIG. 6, an uneven number of sheet transfer elements, in particular sheet transfer cylinders, namely transfer cylinders 110, 120 and 95, is provided downstream of the printing nip of the first printing unit 200.1* and upstream of the printing nip of the second printing unit 200.2* to transfer the sheets S from the first printing unit 200.1* to the second printing unit 200.2*. The only difference with respect to the embodiment of FIG. 6 resides in that not all of the sheet transfer elements 110, 120, 95 or sheet transfer cylinders 110, 120, 95 are an integral part of the first and second printing units 200.1*, 200.2*. Rather, in the example of FIG. 7, only the first sheet transfer element 95 or sheet transfer cylinder 95 and the second sheet transfer element 110 or sheet transfer cylinders 110 are supported between the pair of side frames 201* of the two printing units 200.1*, 200.2*, the third sheet transfer element 120 or sheet transfer cylinder 120 being supported in this case in an intermediate frame 205 that is interposed between the second lateral side 201*b of the first printing unit 200.1* and the first lateral side 201*a of the second printing unit 200.2*. In the illustrated example, the second lateral side 201*b of the second printing unit 200.2* is likewise coupled to an intermediate frame 205 supporting the third sheet transfer element 120 or third sheet transfer cylinder 120 downstream of the second printing unit 200.2***.

From a functional perspective, components 1*, 15A, 15B, 16A, 16B, 25A, 25B, 26A, 26B, 90, 95, 105, 106, 110, 120, 201*, 205, 510, 520 in FIG. 7 fulfill the same function as components 1*, 15A, 15B, 16A, 16B, 25A, 25B, 26A, 26B, 90, 95, 105, 106, 110, 120, 201, 510, 520 described in connection with FIG. 6.

Various modifications and/or improvements may be made to the above-described embodiments without departing from the scope of the invention as defined by the annexed claims.

First of all, any one of the two printing cylinders 105, 106 could be designed as a sheet conveying cylinder and the invention is therefore not limited to the illustrated embodiments where the sheet conveying cylinder is located above the path of the sheets S. The sheet conveying cylinder could equally be located below the path of the sheets S. In one embodiment, the sheet conveying cylinder of a first printing unit is located above the path of the sheets S while a sheet conveying cylinder of an adjacent second printing unit is located below the path of the sheets S. In another embodiment, the sheet conveying cylinder of a first printing unit is located bellow the path of the sheets S while a sheet conveying cylinder of an adjacent second printing unit is located above the path of the sheets S.

Similarly, while FIGS. 6 and 7 show that three sheet transfer cylinders 110, 120, 95 are provided downstream of the printing nip of the first printing unit 200.1, respectively 200.1*, and upstream of the printing nip of the second printing unit 200.2, respectively 200.2*, to ensure transfer of the sheets S from one printing unit to the other, any number of at least two sheet transfer elements or cylinders would be convenient. The number of at least two transfer elements or cylinders is preferably any uneven number of sheet transfer elements or cylinders and more preferably an uneven number of at least three sheet transfer elements or cylinders. The illustrated examples are advantageous in that the at least two sheet transfer elements 110, 120, 95 and in particular the at least three sheet transfer elements 110, 120, 95 or cylinders 110, 120, 95 ensure sufficient spacing between two successive printing units and accessibility to all relevant parts of the printing presses, in particular the plate cylinders 15A, 15B, 16A, 16B and drying/curing units 510, 520.

Alternatively, the three sheet transfer elements 110, 120, 95 or cylinders 110, 120, 95 could be replaced by another number, in particular another uneven number of sheet transfer elements or cylinders, for example five sheet transfer cylinders of the size as sheet transfer cylinder 95 shown in FIG. 6 and/or FIG. 7.

It shall furthermore be appreciated that all relevant printing units do not necessarily need to be strictly identical. The embodiments disclosed herein however have a major advantage in that full modularity is ensured as each individual printing unit is designed as an elementary building block that can be added or removed from the printing press without major difficulties.

LIST OF REFERENCE NUMERALS USED THEREIN

100 Simultan-type printing press—(2+4)-over-(4) configuration (prior art of FIGS. 1 and 2)

100* Simultan-type printing press—(2+4)-over-(2+4) configuration (prior art of FIG. 3)

100 Double-decker-type printing press—(4)-over-(4) configuration (prior art of FIG. 4**)

1000 printing press—(2+2)-over-(2+2) configuration (embodiment of FIG. 6)

1000* printing press—(2+2)-over-(2+2) configuration (embodiment of FIG. 7)

1 sheet feeder

1* feeder table

S sheets

2 printing unit (prior art of FIGS. 1 and 2)

2* printing unit (prior art of FIG. 3)

2.1-2.8 printing units (prior art of FIG. 4)
200 printing unit (embodiment of FIG. 5)
200.1, 200.2 printing units (embodiment of FIG. 6)
200.1*, 200.2* printing units (embodiment of FIG. 7)
3 sheet conveying system (chain gripper system with spaced-apart gripper bars)
31 pair of chain wheels of sheet conveying system 3 (upstream end)
4 sheet delivery unit
41, 42, 43 delivery pile units
5 sheet conveying cylinder/(first) printing cylinder (main printing group)/three-segment blanket cylinder (FIGS. 1 to 3)
5.1-5.4 printing cylinders of printing units 2.1, 2.3, 2.5 and 2.7/one-segment blanket cylinders (FIG. 4)
105 sheet conveying cylinder/(first) printing cylinder/two-segment blanket cylinder (embodiments of FIGS. 5 to 7)
6 (second) printing cylinder (main printing group)/three-segment blanket cylinder (FIGS. 1 to 3)
6.1-6.4 printing cylinders of printing units 2.2, 2.4, 2.6 and 2.8/one-segment blanket cylinders (FIG. 4)
106 (second) printing cylinder/two-segment blanket cylinder (embodiments of FIGS. 5 to 7)
7 sheet conveying cylinder/(third) printing cylinder (additional printing group)/two-segment blanket cylinder (FIG. 3)
8 (fourth) printing cylinder (additional printing group)/two-segment blanket cylinder (FIGS. 1 to 3)
8' sheet conveying cylinder/two-segment cylinder (FIGS. 1 and 2)
9 sheet transfer cylinder (infeed—FIGS. 1 to 4)
9', 9" sheet transfer cylinders (FIG. 3)
90 sheet transfer cylinder (infeed—embodiment of FIGS. 6 and 7)
95 (first) sheet transfer cylinder (embodiments of FIGS. 5 to 7)
10 sheet transfer cylinder (FIGS. 1 to 2)
10', 10", 10''' sheet transfer cylinders (intermediate sheet conveying system interposed between additional printing group and main printing group—FIG. 3)
11 inspection cylinder or drum (part of inspection system—FIGS. 1 to 3)
12 inspection cylinder or drum (part of inspection system—FIGS. 1 to 3)
10.1-10.4 sheet conveying cylinders/impression cylinders of printing units 2.1, 2.3, 2.5 and 2.7/two-segment impression cylinders (FIG. 4)
11.1-11.4 sheet conveying cylinders/impression cylinders of printing units 2.2, 2.4, 2.6 and 2.8/two-segment impression cylinders (FIG. 4)
13 sheet transfer cylinder/two-segment cylinder (FIG. 4)
110 (second) sheet transfer cylinder/two-segment cylinder (embodiments of FIGS. 5 to 7)
120 (third) sheet transfer cylinder/two-segment cylinder (embodiments of FIGS. 5 to 7)
15 (four) plate cylinders cooperating with printing cylinder 5 (lower/verso side of sheets S)/one-segment plate cylinders (FIGS. 1 to 3)
15.1-15.4 plate cylinders of printing units 2.1, 2.3, 2.5 and 2.7 (upper/recto side of sheets S)/one-segment plate cylinders (FIG. 4)
15A, 15B (two) plate cylinders of printing unit 200, 200.1, 200.2, 200.1*, 200.2* (upper/recto side of sheets S)/one-segment plate cylinders (FIGS. 5 to 7)
16 (four) plate cylinders cooperating with printing cylinder 6 (upper/recto side of sheets S)/one-segment plate cylinders (FIGS. 1 to 3)
16.1-16.4 plate cylinders of printing units 2.2, 2.4, 2.6 and 2.8 (lower/verso side of sheets S)/one-segment plate cylinders (FIG. 4)
16A, 16B (two) plate cylinders of printing unit 200, 200.1, 200.2, 200.1*, 200.2* (lower/verso side of sheets S)/one-segment plate cylinders (FIGS. 5 to 7)
17 (two) plate cylinders cooperating with printing cylinder 7 (lower/verso side of sheets S)/one-segment plate cylinders (FIG. 3)
18 (two) plate cylinders cooperating with printing cylinder 8 (upper/recto side of sheets S)/one-segment plate cylinders (FIGS. 1 to 3)
20 printing press main frame/pair of side frames (FIGS. 1 to 4)
201 frame of printing unit 200, 200.1, 200.2/pair of side frames (embodiments of FIGS. 5 and 6)
201*a* connection interface of frame 201/first lateral side (input/upstream side)
201*b* connection interface of frame 201/second lateral side (output/downstream side)
201* frame of printing unit 200.1*, 200.2*/pair of side frames (embodiment of FIG. 7)
201*a connecting interface of frame 201***/first lateral side (input/upstream side)
201*b connecting interface of frame 201***/second lateral side (output/downstream side)
205 intermediate frame (FIG. 7)
21 retractable inking carriage supporting inking apparatuses 25
22 retractable inking carriage supporting inking apparatuses 26
23 retractable inking carriage supporting inking apparatuses 27 (FIG. 3)
24 retractable inking carriage supporting inking apparatuses 28 (FIGS. 1 to 3)
25 (four) inking apparatuses each cooperating with a corresponding one of the plate cylinders 15 (FIGS. 1 to 3)
25.1-25.4 inking apparatus of printing units 2.1, 2.3, 2.5 and 2.7 cooperating with plate cylinder 15.1, 15.2, 15.3, 15.4, respectively (FIG. 4)
25A, 25B (two) inking apparatuses each cooperating with a corresponding one of the plate cylinders 15A, 15B (FIGS. 5 to 7)
26 (four) inking apparatuses each cooperating with a corresponding one of the plate cylinders 16 (FIGS. 1 to 3)
26.1-26.4 inking apparatus of printing units 2.2, 2.4, 2.6 and 2.8 cooperating with plate cylinder 16.1, 16.2, 16.3, 16.4, respectively (FIG. 4)
26A, 26B (two) inking apparatuses each cooperating with a corresponding one of the plate cylinders 16A, 16B (FIGS. 5 to 7)
27 (two) inking apparatuses each cooperating with a corresponding one of the plate cylinders 17 (FIG. 3)
28 (two) inking apparatuses each cooperating with a corresponding one of the plate cylinders 18 (FIGS. 1 to 3)
50 drying/curing unit for recto side of sheets S, e.g. UV-LED curing unit (FIGS. 1 and 2)
51 (first) drying/curing unit for verso side of sheets S, e.g. UV-LED curing unit, cooperating with sheet transfer cylinder 10' (FIG. 3)
52 (second) drying/curing unit for recto side of sheets S, e.g. UV-LED curing unit, cooperating with sheet transfer cylinder 10" (FIG. 3)
510 (first) drying/curing unit for recto side of sheets S, e.g. UV-LED curing unit, cooperating with sheet transfer cylinder 110 (embodiments of FIGS. 5 to 7)

520 (second) drying/curing unit for verso side of sheets S, e.g. UV-LED curing unit, cooperating with sheet transfer cylinder 120 (embodiments of FIGS. 5 to 7)

61 inspection camera (verso side of sheets S) cooperating with inspection cylinder or drum 11, e.g. line-scan camera (FIGS. 1 to 3)

62 inspection camera (recto side of sheets S) cooperating with inspection cylinder or drum 12, e.g. line-scan camera (FIGS. 1 to 3)

T1 sheet transfer location to (first) sheet transfer cylinder 95/sheet input location T2 sheet transfer location away from (third) sheet transfer cylinder 120/sheet output location

The invention claimed is:

1. A sheet-fed printing press adapted to carry out recto-verso printing of individual sheets, the sheet-fed printing press comprising:

a plurality of printing units each adapted to carry out simultaneous recto-verso printing of the sheets, each printing unit including two printing cylinders cooperating with one another and forming a printing nip where both sides of the sheets are simultaneously printed, a first printing cylinder of the two printing cylinders collecting ink patterns from at least two plate cylinders associated with the first printing cylinder and a second printing cylinder of the two printing cylinders collecting ink patterns from at least two plate cylinders associated with the second printing cylinder and wherein the first printing cylinder is located above the second printing cylinder such that the sheets travel laterally through each printing unit from a first lateral side located upstream of the printing nip to a second lateral side opposite to the first lateral side and located downstream of the printing nip, wherein at least two of said printing units are located one after the other, wherein at least two sheet transfer elements are provided downstream of the printing nip of a first printing unit of the at least two of said printing units and upstream of the printing nip of a second printing unit of the at least two of said printing units to transfer the sheets from the first printing unit to the second printing unit, wherein the plate cylinders are each inked by an associated inking apparatus with at least one ink fountain, wherein the inking apparatuses are positioned with at least a portion of each respective ink fountain being located over or under at least a portion of the associated plate cylinder so that a flow of ink from the ink fountain to the plate cylinder is in a substantially vertical direction.

2. The sheet-fed printing press according to claim 1, wherein at least part of the number of the at least two sheet transfer elements is supported in an intermediate frame interposed between the second lateral side of the first printing unit and the first lateral side of the second printing unit.

3. The sheet-fed printing press according to claim 1, wherein the at least two of said printing units are coupled directly to one another, with the second lateral side of the first printing unit being coupled to the first lateral side of the second printing unit, and wherein the number of at least two sheet transfer elements is an integral part of the first and second printing units.

4. The sheet-fed printing press according to claim 1, wherein the two printing cylinders comprise a first printing cylinder acting as a sheet-conveying cylinder, wherein the sheets are transferred to the first printing cylinder by way of a first sheet transfer element or first sheet transfer cylinder cooperating with the first printing cylinder upstream of the printing nip, wherein the sheets are taken away from the first printing cylinder by way of a second sheet transfer element or second sheet transfer cylinder cooperating with the first printing cylinder downstream of the printing nip.

5. The sheet-fed printing press according to claim 4, wherein each printing unit comprises a pair of side frames supporting at least the two printing cylinders as well as the first sheet transfer element or first sheet transfer cylinder and/or the second sheet transfer element or second sheet transfer cylinders.

6. The sheet-fed printing press according to claim 1, wherein each printing unit is configured as a (2)-over-(2) Simultan unit comprising first and second plate cylinders cooperating with a first one of the two printing cylinders to print a first side of the sheets and third and fourth plate cylinders cooperating with a second one of the two printing cylinders to print a second side of the sheets.

7. The sheet-fed printing press according to claim 1, wherein the plate cylinders are each inked by an associated inking apparatus, the inking apparatuses each comprising two ink fountains.

8. The sheet-fed printing press according to claim 1, further comprising at least one respective drying or curing unit located downstream of the respective printing nip between the two printing cylinders of the respective printing unit.

9. The sheet-fed printing press according to claim 8, comprising first and second drying or curing units each cooperating with an associated sheet transfer element to dry first and second sides of the sheets.

10. The sheet-fed printing press according to claim 9, wherein each printing unit is provided with the first and second drying or curing units and associated sheet transfer elements.

11. The sheet-fed printing press according to claim 8, wherein the at least one respective drying or curing unit is a UV-curing unit and/or a UV-LED curing unit.

12. The sheet-fed printing press according to claim 1, wherein the sheet-fed printing press is adapted to carry out recto-verso printing of individual sheets for the production of security documents.

13. The sheet-fed printing press according to claim 12, wherein the security documents are banknotes.

14. The sheet-fed printing press according to claim 1, wherein this at least one straight reference line together with a vertical straight line confines an angle that is smaller than 25° and/or smaller than 20°.

15. The sheet-fed printing press according to claim 1, wherein at least one of the sheet transfer elements is embodied as a gripper system or as a chain gripper system or as a sheet transfer cylinder comprising at least one gripper system and/or wherein a first sheet transfer element is embodied as a first sheet transfer cylinder and/or a second sheet transfer element is embodied as a second sheet transfer cylinder and/or a third sheet transfer element is embodied as a third sheet transfer cylinder.

16. The sheet-fed printing press according to claim 1, wherein the number of at least two sheet transfer elements is an uneven number of at least three sheet transfer elements.

* * * * *